US005941783A

United States Patent [19]

Schneider

[11] Patent Number: 5,941,783

[45] Date of Patent: Aug. 24, 1999

[54] METHOD OF DESIGNATING A PLAYER'S TEAM POSITION

[76] Inventor: James T. Schneider, 111 Greenboro La., Pittsburgh, Pa. 15520

[21] Appl. No.: 08/818,100

[22] Filed: Mar. 14, 1997

[51] Int. Cl.[6] ..... A63B 69/00

[52] U.S. Cl. ..... 473/450

[58] Field of Search ..... 273/247, 259; 2/113; 473/338, 450, 124

[56] References Cited

U.S. PATENT DOCUMENTS 1,613,530 1/1927 Peterson ..... 273/247

1,905,303 4/1933 Potter ..... 273/247

*Primary Examiner*—Theatrice Brown

*Attorney, Agent, or Firm*—Linkiak, Berenato, Longacre & White, LLC

[57] ABSTRACT

A method for conducting the game of football is disclosed. In this method, each player is given a designation consisting of a combination of a single letter and certain selected numbers worn on his uniform that directly identifies the player and his assigned position.

5 Claims, 1 Drawing Sheet

METHOD OF DESIGNATING A PLAYER'S TEAM POSITION

BACKGROUND OF THE INVENTION

This invention relates to a method for conducting the game of football. More particularly, this invention relates to a method of designating a player and his assigned position by a combination of a single letter and certain selected numbers worn on the player's uniform during the game.

Certain rules in the game of football place restrictions on players of certain specific positions. Because of these rules, it is often necessary to be able to ascertain at a particular moment during a football game, what position a given player assumed before the ball was put in play. It is also desirable for the fans convenience, as well as that of the sports media (e.g. television) covering the game, to designate players by certain uniform indicia so that each player on every team and his position may be readily identified by reference to the uniform indicia alone.

Currently, this is done by placing numbers on various locations of the uniform and, in some instances, by placing the players name on the upper back portion of his jersey. In recent years, a relatively uniform system of numbering has been developed so as to designate positions by a number within a certain range (e.g. quarterbacks Nos. 1–20). While this has worked to some extent, there is a need for further improvement. For example, the present system fails to immediately convey the specific position of a player, whether he is a member of the offensive or defensive team, and whether he is a first team player or a reserve.

SUMMARY OF THE INVENTION

It is an object and purpose of this invention to fulfill this need and to provide this further improvement. Other objects and purposes will become more apparent to the skilled artisan once given the following disclosure.

Generally speaking, this invention comprises a method for playing football which comprises designating each player with a combined single letter-number code located prominently on a portion of his playing apparel. In preferred embodiments, the letter code designation precedes the number code designation. In further preferred embodiments, the letter code designates the player's position, while the number code designates offense or defense (e.g. odd numbers for offense, even numbers for defense). In further preferred embodiments, the letters used are the initials of the position played (e.g. Q for quarterback) and the code is located on the helmet and jersey (front, rear and shoulders) of the player. In still further preferred embodiments, the number code also designates whether a player is on the first team or is a reserve and the letter codes are all different.

This invention will now be described with respect to certain embodiments in accompaniment with the attached illustrations wherein:

DETAILED DESCRIPTION OF THE INVENTION

Figure 1:
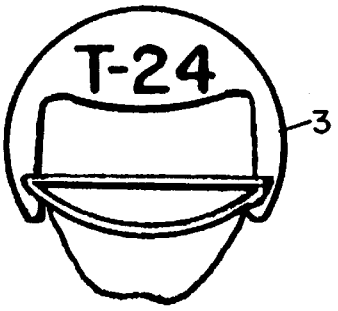
FIG. 1 is a front view of a head and helmet of a player.
Figure 2:
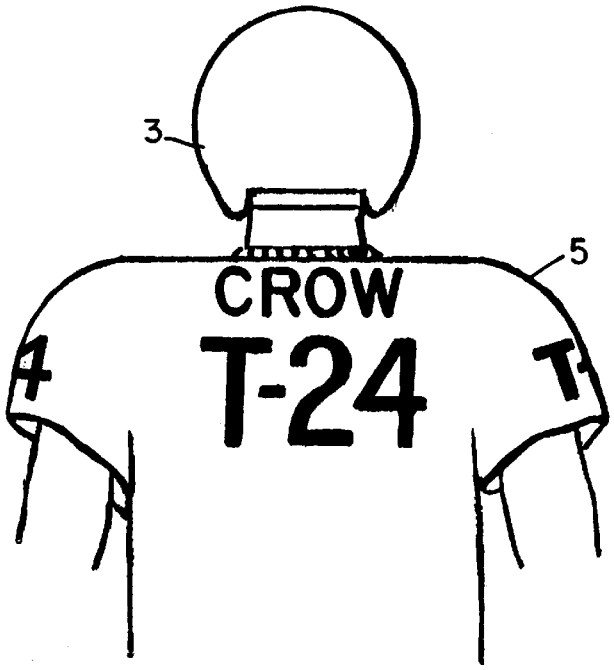
FIG. 2 is an upper torso view of the player of FIG. 1.
Figure 3:
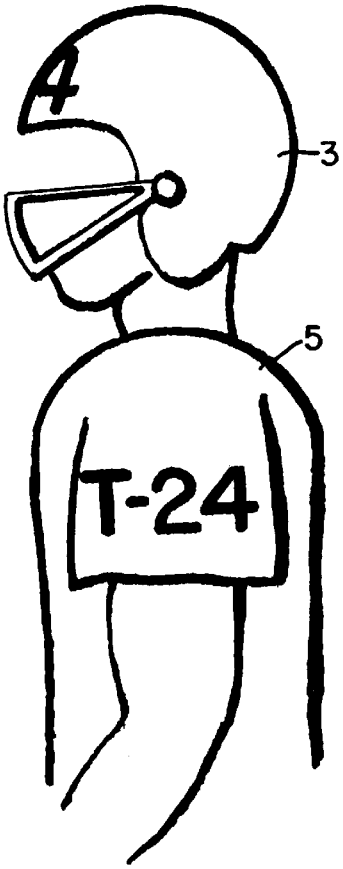
FIG. 3 is a side view of FIG. 2.
Figure 4:
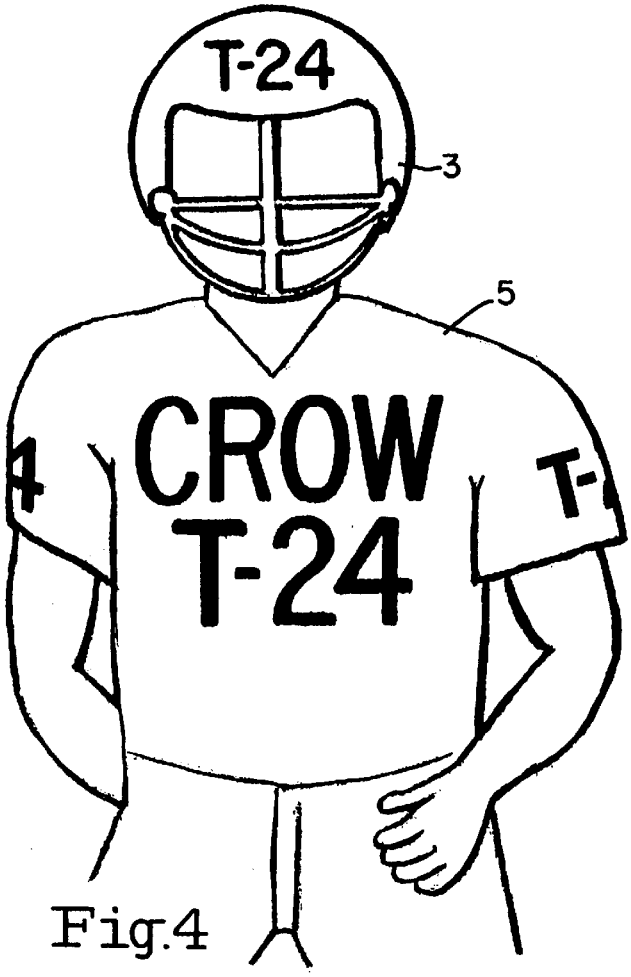
FIG. 4 is a partial, front perspective view of the player of FIG. 1.

FIGS. 1–4 illustrate a player prominently displaying a typical letter-number code according to this invention. As illustrated, the code is displayed on his helmet 3 and his jersey 5. The code is prominently displayed on jersey 5 on the rear (FIG. 2), front (FIG. 4) and side shoulders (FIGS. 3–4). The player's name (e.g. CROW) can also be displayed front and/or rear if desired, as illustrated in FIGS. 2 and 4.

In the illustrated embodiment, the letter T precedes the number 4, designating T for tackle position and 4, an even number, designating defense. Other combinations can, of course, be used. For example, odd numbering could instead be utilized to designate offensive players with defensive players designated by even numbers. Additionally, the number designations used in connection with each position can also carry a particular meaning. For example, they could be used to designate first team and second team players at a given position (e.g. Q-1 for first team quarterback and Q-3 for second team quarterback). Alternatively, the number designations could also be used to indicate details concerning a particular position of a player (e.g. G-21 and G-23 for left guards and G-25 and G-27 for right guards).

Exemplary of designations that can be conveniently used for a team are as follows:

EXAMPLE I

| Offense | Letter With Odd Number |
|---|---|
| Quarterback | Q-1; 3; 5; 7; 9 |
| Center | C-11; 13; 15; 17; 19 |
| Guards | G-21; 23; 25; 27; 29 |
| Tackles | T-31; 33; 35; 37; 39 |
| Tight Ends | E-41, 43; 45; 47; 49 |
| Wide Receivers | W-51; 53; 55; 57; 59 |
| Half Backs | H-61; 63; 65; 67; 69 |
| Full Backs | F-71; 73; 75 |
| Kickers, Punters | K-81; 83; 85; P-87; 89 |
| **Defense** | **Letters With Even Numbers** |
| Tackles | T-20; 22; 24; 26; 28 |
| Ends | E-40; 42; 44; 46; 48 |
| Middle Linebackers | M-60; 62; 64; 66; 68 |
| Outside Linebackers | L-70; 72; 74; 76 |
| Defensive Backs | B-90; 92; 94; 96; 98 |
| Defensive Safetys | S-2; 4; 6; 8 |

EXAMPLE II

Forty-Man Squad

Key:

1) Letter identifies position followed by:
2) Odd number for offense
3) Even number for defense

| OFFENSE | LETTER WITH ODD NUMBER | NO. OF PLAYERS |
|---|---|---|
| Quarterbacks | Q-1; 3; 5 | 3 |
| Centers | C-11; 13 | 2 |
| Guards | G-21; 23; 25 | 3 |
| Tackles | T-31; 33; 35 | 3 |
| Tight Ends | E-41; 43; 45 | 3 |
| Wide Receivers | W-51; 53; 55 | 3 |
| Half Backs | H-61; 63 | 2 |
| Full Backs | F-71; 73 | 2 |
| Kickers, Punters | K-81; P-87 | 2 |
| | Total | 23 |

-continued

| DEFENSE | LETTER WITH EVEN NUMBER | NO. OF PLAYERS |
|---|---|---|
| Tackles | T-20; 22; 24; 26 | 4 |
| Ends | E-40; 42; 44 | 3 |
| Middle Linebackers | M-60; 62; 64 | 3 |
| Outside Linebackers | L-74; 76 | 2 |
| Corner Backs | B-90; 92; 94 | 3 |
| Safeties | S-2; 4 | 2 |
| | Total | 17 |
| | Grand Total | 40 |

It is also possible to use the present invention in combination with teams of greater than forty players. An example of this embodiment of the present invention is set forth below where the rosters of three professional football teams were reviewed to determine the average number of players of each position. A code containing a single letter and a single number was then assigned to each position. It should be noted that the designations in the code also provided an indication of whether each player was on the first or starting team.

EXAMPLE III

Forty-three Man Squad

| | Total Positions of Three Teams | Average |
|---|---|---|
| Offense | | |
| Center | 6 | 2 |
| Guard | 10 | 3 |
| Kicker | 3 | 1 |
| Tackle | 8 | 3 |
| Punter | 3 | 1 |
| Quarterback | 9 | 3 |
| Running back | 16 | 5 |
| Tight end | 9 | 3 |
| Wide receiver | 12 | 4 |
| | 76 | 25 |
| Defense | | |
| Corner back | 9 | 3 |
| Defensive end | 10 | 3 |
| Tackle | 8 | 3 |
| Linebacker | 17 | 6 |
| Safety | 9 | 3 |
| | 53 | 18 |
| | 129 | 43 |

Code as follows:

| | Letter-Number Designation | Total Pstns | First Team Designations | First Team Total Pstns |
|---|---|---|---|---|
| Offense | | | | |
| Center | C5, C7 | 2 | C5 | 1 |
| Guard | G1, G3, G5 | 3 | G1, G3 | 2 |
| Kicker | K1 | 1 | | |
| Tackle | T5, T7, T9 | 3 | T5, T7 | 2 |
| Punter | P1 | | | |
| Quarterback | Q5, Q7, Q9 | 3 | Q5 | 1 |
| Running back | R9, R7, R5 R3, R1 | 5 | R9, R7 | 2 |
| Tight end | E9, E7, E5 | 3 | E9 | 1 |
| Wide receiver | W1, W3, W5, W7 | 4 | W1, W3 | 2 |
| | | 25 | | 11 |
| Defense | | | | |
| Corner back | B8, B6, B4 | 3 | B8, B6 | 2 |
| End | E2, E4, E6 | 3 | E2, E4 | 2 |
| Tackle | T6, T4, T2 | 3 | T6, T4 | 2 |
| Line backer | L2, L4, L6, L8, L10, L12 | 6 | L2, L4, L6 | 3 |
| Safety | S8, S6, S4 | 3 | S8, S6 | 2 |
| | | 18 | | 11 |
| Total | | 43 | | |

In another embodiment of the present invention the better portion of the letter-number code utilizes a different letter to designate each position. In this manner each player of a given position has a letter designation different from players of all other position, regardless of whether they are on the offensive or defensive teams. An example of letter designations that could be used in such a letter-number code are as follows:

| OFFENSE | | DEFENSE | |
|---|---|---|---|
| Quarterback | Q | Tackles | T |
| Center | C | Ends | D |
| Guards | G | Middle Linebackers | M |
| Tackles | T | Outside Linebackers | O |
| Tight Ends | E | Corner Backs | B |
| Wide Receiver | W | Defensive Safetys | S |
| Half Back | H | | |
| Full Back | F | | |
| Kickers, Punters | K or P | | |

Once given the above description, many other features, modifications and improvements will become apparent to the skilled artisan. Such other features, modifications and improvements are, therefore, to be considered a part of this invention, the scope of which is to be determined by the following claims:

I claim:

1. A method of designating a player's assigned position by a combination of a single letter and a selected number worn on his uniform during game play;

providing a letter-number code placed on apparel worn by each player during game play, said letter-number code immediately providing an of actual human football wherein a human player is dressed in playing apparel the improvement comprising providing each player with a combined letter-number code located prominently on a portion of his playing apparel;

providing an immediate indication of both the position of the player and whether the player is an offensive or defensive player, the offensive and defensive players having different numbers;

wherein said combined letter-number code has a preselected meaning; and wherein the player is a member of a team comprised of 40 members and is designated by one of the following codes:

| | OFFENSE | DEFENSE |
|---|---|---|
| Quarterbacks | Q-1; 3; 5 | |
| Centers | C-11; 13 | |
| Guards | G-21; 23; 25 | |
| Tackles | T-31; 33; 35 | |
| Tight Ends | E-41; 43; 45 | |
| Wide Receivers | W-51; 53; 55 | |
| Half Backs | H-61; 63 | |
| Full Backs | F-71; 73 | |
| Kickers, Punters | K-81; P-87 | |
| Tackles | | T-20; 22; 24; 26 |
| Ends | | E-40; 42; 44 |
| Middle Linebackers | | M-60; 62; 64 |
| Outside Linebackers | | L-74; 76 |
| Corner Backs | | B-90; 92; 94 |
| Defensive Safety | | S-2; 4. |

2. A method of designating a player's assigned position by a combination of a single letter and a selected number worn on his uniform during game play;

providing a letter-number code placed on apparel worn by each player during game play, said letter-number code immediately providing an indication of both the position of the player and whether the player is an offensive or defensive player, the offensive and defensive players having different numbers;

wherein said combined letter-number code has a preselected meaning; and wherein the player is a member of a team comprised of a plurality of players, each of said players being designated with a different letter-number code according to his position and selected from the following code:

(a) the offense bearing numbers selected from only one of two classes of numbers, a first of said two classes consisting of only odd numbers and a second of said two classes consisting only of even numbers, the defense bearing only numbers selected from the other of said two classes; and (b) the letters selected by position played and designated as follows:

| OFFENSE | | DEFENSE | |
|---|---|---|---|
| Quarterback | Q | Tackles | T |
| Center | C | Ends | D |
| Guards | G | Linebackers | L |
| Tackles | T | Defensive Backs | B |
| Tight Ends | E | Defensive Safetys | S. |
| Wide Receiver | W | | |
| Running Back | R | | |
| Full Back | F | | |
| Kickers Punters | K or P | | |

3. A method of designating a player's assigned position by a combination of a single letter and a selected number worn on his uniform during game play;

providing a letter-number code placed on apparel worn by each player during game play, said letter-number code immediately providing an indication of both the position of the player and whether the player is an offensive or defensive player, the offensive and defensive players having different numbers;

wherein said combined letter-number code has a preselected meaning; and wherein the player is a member of a team comprised of forty-three players, each player being designated by a letter-number code according to his position as follows:

| | Letter-Number Designation | First Team Designations |
|---|---|---|
| Offense | | |
| Center | C5, C7 | C5 |
| Guard | G1, G3, G5 | G1, G3 |
| Kicker | K1 | |
| Tackle | T5, T7, T9 | T5, T7 |
| Punter | P1 | |
| Quarterback | Q5, Q7, Q9 | Q5 |
| Running back | R9, R7, R5, R3, R1 | R9, R7 |
| Tight end | E9, E7, E5 | E9 |
| Wide receiver | W1, W3, W5, W7 | W1, W3 |
| Defense | | |
| Corner back | B8, B6, B4 | B8, B6 |
| End | E2, E4, E6 | E2, E4 |
| Tackle | T6, T4, T2 | T6, T4 |
| Linebacker | L2, L4, L6, L8, L10, L12 | L2, L4, L6 |
| Safety | S8, S6, S4 | S8, S6. |

4. A method of designating a player's assigned position by a combination of a single letter and a selected number worn on his uniform during game play;

providing a letter-number code placed on apparel worn by each player during game play, said letter-number code immediately providing an indication of both the position of the player and whether the player is an offensive or defensive player, the offensive and defensive players having different numbers;

wherein said combined letter-number code has a preselected meaning; and wherein the player is a member of a team comprised of a plurality of players, each of said players being designated with a different letter-number code according to his position and selected from the following code:

(a) the offense bearing numbers selected from only one of two classes of numbers, a first of said two classes consisting of only odd numbers and a second of said two classes consisting only of even numbers, the defense bearing only numbers selected from the other of said two classes; and b) the letters are of said letter-number code and selected by position played with no two letters for any two positions being the same.

5. The method of claim 4 wherein the letters of the letter-number codes are designated as follows:

| OFFENSE | | DEFENSE | |
|---|---|---|---|
| Quarterback | Q | Tackles | L |
| Center | C | Ends | D |
| Guards | G | Middle Linebackers | M |
| Tackles | T | Outside Linebackers | O |
| Tight Ends | E | Corner Backs | B |
| Wide Receiver | W | Defensive Safetys | S |
| Half Back | H | | |
| Full Back | F | | |
| Kickers, Punters | K or P | | |

* * * * *